US007495394B2

(12) United States Patent
Song et al.

(10) Patent No.: US 7,495,394 B2
(45) Date of Patent: Feb. 24, 2009

(54) PLASMA DISPLAY PANEL PROVIDED WITH IMPROVED BUS ELECTRODES

(75) Inventors: Young-Hwa Song, Suwon-si (KR); Seung-Heon Oh, Suwon-si (KR); Chang-Seok Rho, Suwon-si (KR); Cheol-Hee Moon, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 793 days.

(21) Appl. No.: 10/994,373

(22) Filed: Nov. 23, 2004

(65) Prior Publication Data

US 2005/0110405 A1 May 26, 2005

(30) Foreign Application Priority Data

Nov. 26, 2003 (KR) ..... 10-2003-0084441

(51) Int. Cl.
*H01J 17/49* (2006.01)

(52) U.S. Cl. ..... 313/582; 313/491; 313/631; 313/583

(58) Field of Classification Search ..... 313/582–587, 313/491, 631
See application file for complete search history.

(56) References Cited

U.S. PATENT DOCUMENTS 6,891,331 B2 * 5/2005 Ashida et al. ..... 313/582
2005/0104520 A1 * 5/2005 Hong et al. ..... 313/582

FOREIGN PATENT DOCUMENTS

| | | | |
|---|---|---|---|
| EP | 1150320 | A1 * | 10/2001 |
| JP | 2000-260334 | | 9/2000 |
| KR | 10-1998-0072756 | A | 11/1998 |
| KR | 10-1999-0074997 | A | 10/1999 |

* cited by examiner

*Primary Examiner*—Toan Ton
*Assistant Examiner*—Kevin Quarterman
(74) *Attorney, Agent, or Firm*—H.C. Park & Associates, PLC

(57) ABSTRACT

A plasma display panel comprising a first substrate and a second substrate provided opposing one another with a predetermined gap therebetween, display electrodes formed on the first substrate, address electrodes formed on the second substrate substantially perpendicularly to the display electrodes, barrier ribs mounted in the gap between the first substrate and the second substrate and defining a plurality of discharge cells, and phosphor layers formed using a phosphor layer material within each of the discharge cells. The display electrodes have bus electrodes running along a direction crossing with the address electrodes, and a cross-sectional shape of the bus electrodes is convex toward the second substrate.

20 Claims, 3 Drawing Sheets

PLASMA DISPLAY PANEL PROVIDED WITH IMPROVED BUS ELECTRODES

CROSS REFERENCE TO RELATED APPLICATION

This application claims priority to and the benefit of Korean Patent Application No. 10-2003-0084441, filed on Nov. 26, 2003, which is hereby incorporated by reference for all purposes as if fully set forth herein.

BACKGROUND OF THE INVENTION

1. Field of the Invention

The present invention relates to a plasma display panel (PDP), and in particular, to a PDP having bus electrodes with an improved shape, thereby enhancing the PDP's contrast and discharge characteristics.

2. Discussion of the Background

Generally, a PDP displays images using plasma discharge. Applying voltages to electrodes formed on substrates of the PDP generates a plasma discharge between the electrodes, which generates ultraviolet rays. The ultraviolet rays excite phosphor layers to display desired images.

PDPs may be classified into an alternating current (AC) type, a direct current (DC) type, and a hybrid type.

FIG. 1 is an exploded perspective view of an AC PDP 100. As shown in FIG. 1, the PDP 100 includes a bottom substrate 104, address electrodes 102 formed on the bottom substrate 104, a dielectric layer 106 covering the address electrodes 102, a plurality of barrier ribs 105 formed on the dielectric layer 106, and phosphor layers 101 formed on the dielectric layer 106 and sides of the barrier ribs 105.

Display electrodes 112, comprising transparent electrodes 107 and bus electrodes 108, are formed orthogonally to the address electrodes 102 on a top substrate 110. A dielectric layer 109 and a protective layer 103 cover the display electrodes 112.

With the above-structured PDP 100, applying driving voltages to the address and bus electrodes 102 and 108 generates an addressing discharge between them, thereby forming wall charges within the selected discharge cells. Alternating current signals may then be alternately applied to the display electrodes 112 of the selected discharge cells, thereby generating the sustain discharge.

The AC PDP's transparent electrodes 107 are typically formed with indium oxide ($In_2O_3$), and they are often referred to as indium tin oxide (ITO) electrodes. The ITO electrodes are transparent, and they are evenly formed on the large-sized panel with excellent affinity with the neighboring materials. However, since the ITO electrodes have relatively low conductivity, Ag or Cr—Cu—Cr bus electrodes may be formed along an edge of the ITO electrodes to achieve the required electrical conductivity. The bus electrodes normally extend to the periphery of the panel, where they may be coupled to driving circuits. The address electrodes are often formed with a highly-conductive Ag paste material.

FIG. 2 is a partial sectional view of the top substrate 110 of the PDP 100. As shown in FIG. 2, the bus electrodes 108 may be composed of white electrode portions 1081(W) and black electrode portions 1082(B).

As shown in FIG. 2, conventionally formed bus electrodes 108 may have curl shapes at both edges. Vapors may form within the dielectric layer (109 of FIG. 1) due to these edge curls when the dielectric layer 109 is formed covering the bus electrode 108, thereby causing the inter-voltages of bus electrodes 108 to drop and mis-discharge to occur in the discharge cells corresponding to such electrodes. Therefore, an improved electrode structure is desired.

SUMMARY OF THE INVENTION

The present invention provides an improved design for a PDP.

The present invention also provides a bus electrode with an improved design that may enhance the PDP's discharge characteristics, including contrast.

Additional features of the invention will be set forth in the description which follows, and in part will be apparent from the description, or may be learned by practice of the invention.

The present invention discloses a PDP comprising a first substrate and a second substrate provided opposing one another with a predetermined gap therebetween, address electrodes formed on the second substrate, display electrodes formed on the first substrate and in a direction crossing the address electrodes, and barrier ribs mounted in the gap between the first substrate and the second substrate and defining a plurality of discharge cells. The display electrodes have bus electrodes running along the direction crossing the address electrodes, and a cross-sectional shape along a width direction of the bus electrodes is convex toward the second substrate.

The present invention also discloses a PDP comprising a first substrate, a second substrate, address electrodes formed on the second substrate, display electrodes formed on the first substrate and in a direction crossing the address electrodes, and a discharge cell defined by an address electrode and a pair of display electrodes. A display electrode comprises a bus electrode, and a width of the bus electrode decreases in a direction from the first substrate to the second substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
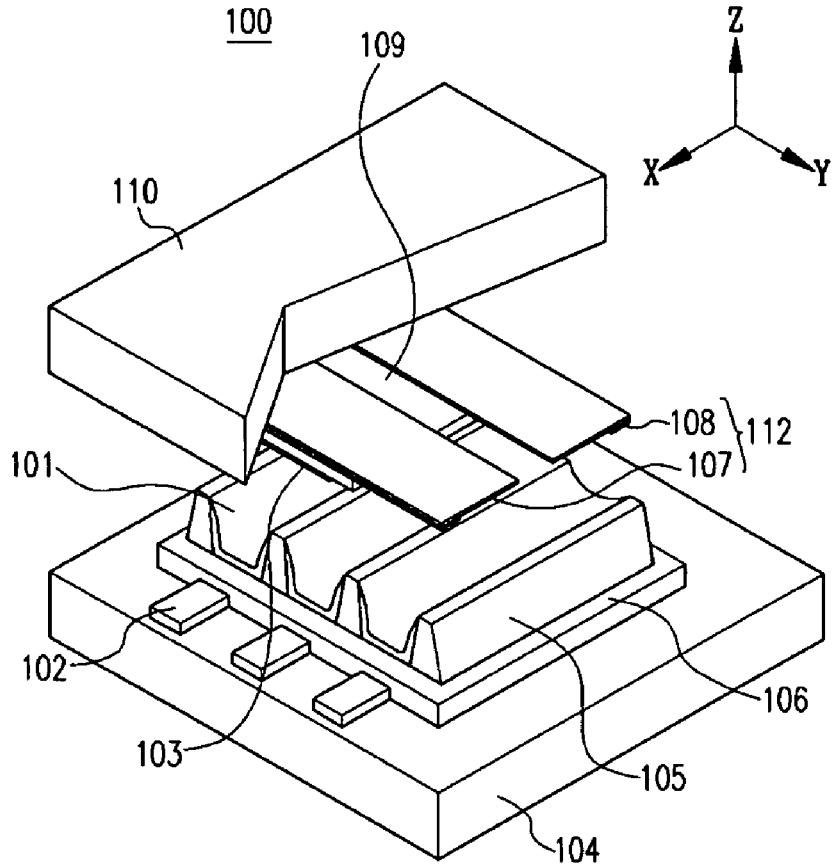
FIG.1 (Prior Art)
FIG. 1 is an exploded perspective view of a PDP.
Figure 2:
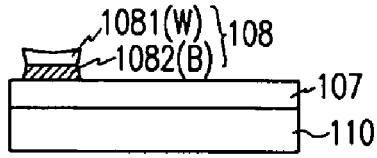
FIG.2 (Prior Art)
FIG. 2 is a partial sectional view of a first substrate of a PDP.

The following detailed description shows and describes exemplary embodiments of the present invention by referring to enclosed drawings. As will be realized, the invention is capable of modification in various obvious respects, all without departing from the invention. Accordingly, the drawings and description are to be regarded as illustrative in nature, and not restrictive. In the drawings, parts not related to the explanation are not shown for clear explanation, and the same elements have the same reference signs.

Figure 3:
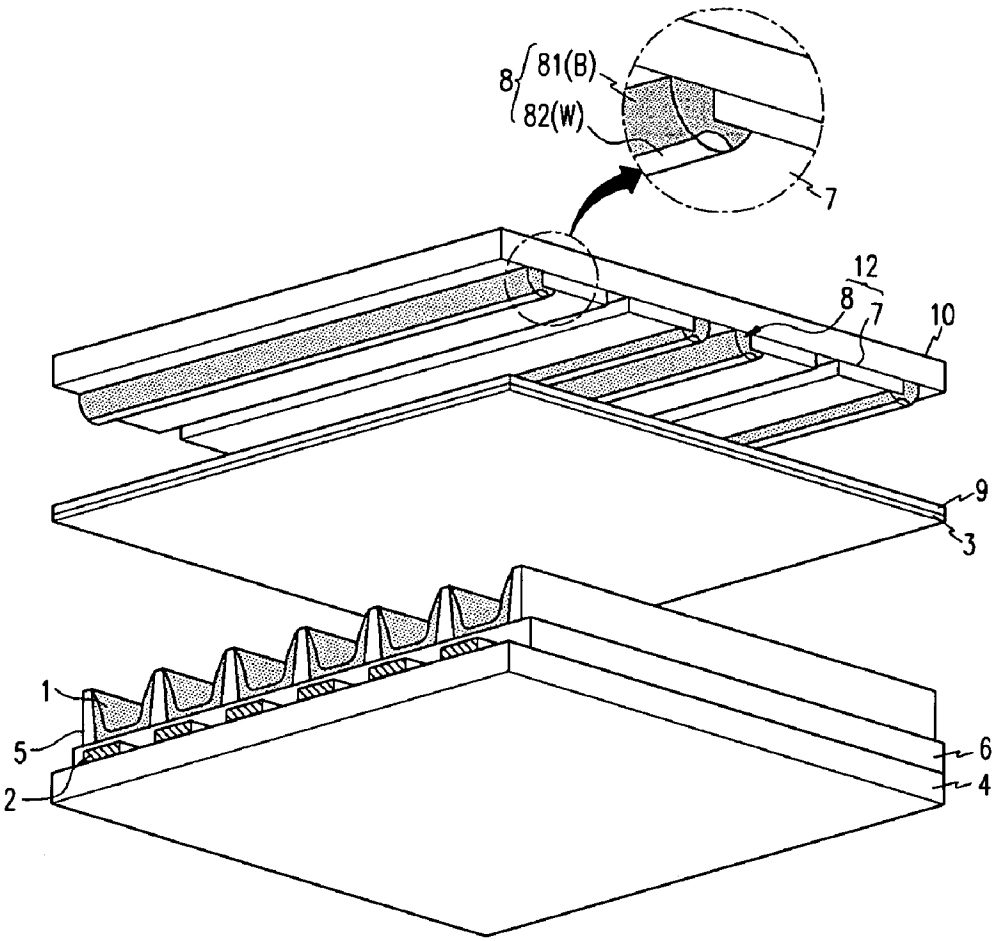
FIG. 3 is a partial exploded perspective view of a PDP according to a first exemplary embodiment of the present invention.

FIG. 3 is an exploded perspective view of a PDP according to a first exemplary embodiment of the present invention. As shown in FIG. 3, the PDP has a plurality of display electrodes 12 extending in a first direction and formed on a first substrate 10. The display electrodes 12 include transparent electrodes 7 and bus electrodes 8.

As the transparent electrodes 7 may have a relatively high resistance, it may be difficult for them to transfer electricity. Thus, bus electrodes 8 may be formed with Ag or other like substances to achieve the required electrical conductivity.

In this exemplary embodiment, the bus electrodes 8 may be formed by depositing at least two layers with a brightness difference, where first electrode portions 81(B) have black tones and second electrode portions 82(W) have white tones and are formed on the first electrode portions 81(B). The first and second electrode portions 81(B), 82(W) are formed with relatively high conductive materials.

Adding a black pigment to the first electrode portions 81(B) may control the color of the black tones. A dielectric layer 9 and a protective layer 3 may be formed on the first substrate 10 to cover the display electrodes 12. The protective layer 3 may be made of magnesium oxide (MgO).

A plurality of address electrodes 2 is formed on a surface of the second substrate 4 and in a direction crossing the display electrodes 12. A dielectric layer 6 covers the address electrodes 2.

A plurality of barrier ribs 5 is formed to partition the respective pixels each with a separate discharge cell, while supporting the first and second substrates 10 and 4. Red (R), green (G), and blue (B) phosphor layers 1 are formed on the inner walls of the discharge cells to generate visible light.

As shown in the circle of FIG. 3 emphasizing a display electrode 12, the bus electrode 8 is formed such that a width of its cross section decreases in a direction toward the second substrate 4. In other words, the bus electrode 8 has a convex cross-sectional shape toward the second substrate 4.

In this exemplary embodiment, the bus electrode's cross-sectional shape is substantially semicircular, which includes substantially semi-elliptical, and they are formed along one edge of the transparent electrodes 7. Further, the first electrode portions 81(B) are wider than the second electrode portions 82(W).

With the above described structure, there is no edge curl or the like at the edge of the bus electrodes 8, as compared to conventional bus electrodes. Such a structure may be formed by an offset printing process.

In other words, in forming the bus electrodes 8, first electrode portions 81(B) may be printed in contact with one longitudinal edge of the transparent electrodes 7 by the offset printing process, and then the second electrode portions 82(W) may be printed onto the first electrode portions 81(B). Finally, the resulting bus electrodes 8 may be fired. Additionally, after depositing the first electrode portion 81(B) on the second electrode portion 82(W), they may be printed simultaneously.

Figure 4:
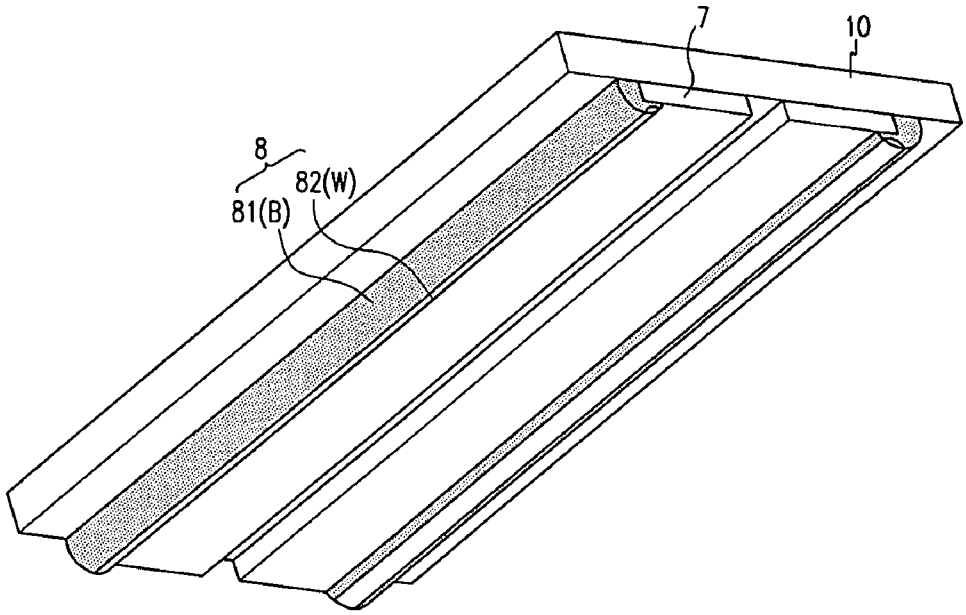
FIG. 4 is a partial perspective view of a PDP according to a second exemplary embodiment of the present invention.
Figure 5:
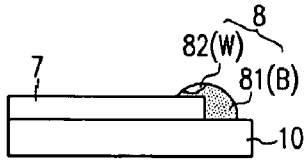
FIG. 5 is a partial sectional view of the first substrate of a PDP according to the second exemplary embodiment of the present invention.

With the above structured PDP, various advantages may be achieved by the position of the second electrode portion 82(W), as shown in FIG. 4 and FIG. 5.

FIG. 4 is a partial perspective view of a PDP according to a second exemplary embodiment of the present invention, and FIG. 5 is a partial sectional view of the first substrate of the PDP of FIG. 4.

The fundamental structure of the bus electrodes 8 shown in FIG. 4 and FIG. 5 is the same as in the above structure, except that the second electrode portions 82(W) are offset from the center of the first electrode portions 81(B). Specifically, the bus electrodes 8 are arranged along an edge of transparent electrodes 7, and they are formed such that the second electrode portions 82(W) are formed on the first electrode portions 81(B) while being offset from the center of the first electrode portions 81(B) and toward a center of the discharge cell.

With the above structure, the first electrode portion 81(B) with the black tones color may have a larger cross-sectional size as compared to the prior art, thereby improving the PDP's contrast. Further, positioning the first electrode portions 81(B) at sites where contrast enhancing layers were typically formed may permit enhanced contrast without depositing contrast enhancing layers (or black stripes) between the display electrodes.

Also, the second electrode portion 82(W) may be formed convexly toward the first and second substrates 10, 4 by the offset process. Accordingly, as shown in FIG. 5, the second electrode portion 82(W) may have a substantially elliptical cross-sectional shape, thereby preventing the edge curl from being produced. As a result, the withstanding voltage of bus electrodes and the state of discharge may be stabilized.

In the present invention, the depth of the bus electrodes 8 may be proportional to their width, where the depth and width satisfy the following formula 1.

$$D=k\times W \qquad \text{[formula 1]}$$

Here, D is the depth (μm) of the bus electrode, W is the width (μm) of the bus electrode, and K is a constant having a value in a range of 1/50 to 1/5 for all portions of the electrode, both inside and outside a panel display area. If the constant K is less than 1/50, the electrode may be cut. On the other hand, when the constant K exceeds 1/5, the electrode becomes so wide that interference with neighboring electrodes may occur, or a connection with an FPC-like electrical connector outside the panel display area may deteriorate. Thus, if electrode thickness varies with location, the electrodes may be designed so that their width commensurately varies to keep the constant the same. In a typical offset printing process, the depth of the line has a range from 2 μm to 5 μm, and the width of the line has a range from 40 μm to 200 μm.

In the PDP according to exemplary embodiments of the present invention, enhancing the cross-sectional shape of bus electrodes may improve the PDP's contrast, thereby providing images of high definition and enhancing the discharge characteristic. Also, eliminating formation of an edge curl or the like at edges of the electrodes may protect discharge cells from damage.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate and a second substrate provided opposing one another with a gap therebetween;

address electrodes formed on the second substrate;

display electrodes formed on the first substrate and in a direction crossing the address electrodes; and barrier ribs mounted in the gap between the first substrate and the second substrate and defining a plurality of discharge cells;

wherein the display electrodes comprise bus electrodes formed along the direction crossing the address electrodes, and wherein a cross-sectional shape of the bus electrodes has a constant rate of curvature and is convex in a direction toward the second substrate.

2. The PDP of claim 1, wherein the cross-sectional shape of the bus electrodes is substantially semicircular.

3. The PDP of claim 1, wherein the bus electrodes comprise at least two layers with a brightness difference.

4. The PDP of claim 3, wherein the bus electrodes comprise:

a first electrode portion with a color of black tones; and a second electrode portion with a color of white tones, wherein the second electrode portion is formed on the first electrode portion.

5. The PDP of claim 4, wherein the first electrode portion is wider than the second electrode portion.

6. The PDP of claim 4, wherein the second electrode portion is formed off-set from a center of the first electrode portion.

7. The PDP of claim 6, wherein the second electrode portion is off-set in a direction towards a center of a corresponding discharge cell.

8. The PDP of claim 6, wherein a cross-sectional shape of the second electrode portion is convex in the direction toward the second substrate and in a direction toward the first substrate.

9. The PDP of claim 4, wherein the display electrodes further comprise transparent electrodes;

wherein the bus electrodes are arranged along an edge of the transparent electrodes; and wherein the second electrode portion is formed off-set from a center of the first electrode portion and toward a center of a corresponding discharge cell.

10. The PDP of claim 9, wherein a cross-sectional shape of the second electrode portion is convex in the direction toward the second substrate and in a direction toward the first substrate.

11. A plasma display panel (PDP), comprising:

a first substrate and a second substrate provided opposing one another with a gap therebetween;

address electrodes formed on the second substrate;

display electrodes formed on the first substrate and in a direction crossing the address electrodes; and barrier ribs mounted in the gap between the first substrate and the second substrate and defining a plurality of discharge cells;

wherein the display electrodes comprise bus electrodes formed along the direction crossing the address electrodes, wherein a cross-sectional share of the bus electrodes is convex in a direction toward the second substrate, wherein a depth of the bus electrodes and a width of the bus electrodes satisfy a formula $D=k\times W$, and wherein D is the depth of the bus electrodes, W is the width of the bus electrodes, and k is a constant.

12. The PDP of claim 11, wherein k has a value in a range of $1/5$ to $1/50$.

13. The PDP of claim 1, wherein the bus electrodes are formed by offset printing.

14. A plasma display panel (PDP), comprising:

a first substrate;

a second substrate;

address electrodes formed on the second substrate;

display electrodes formed on the first substrate and in a direction crossing the address electrodes; and a discharge cell defined by an address electrode and a pair of display electrodes, the pair of display electrodes comprising a bus electrode and a stripe-shaped transparent electrode, the bus electrode being arranged to contact two surfaces of the transparent electrode, and wherein a width of the bus electrode decreases in a direction from the first substrate to the second substrate.

15. The PDP of claim 14, wherein a cross-sectional shape of the bus electrode is substantially semicircular.

16. The PDP of claim 14, wherein the bus electrode comprises:

a first electrode portion with a color of black tones; and a second electrode portion with a color of white tones, wherein the second electrode portion is formed on the first electrode portion.

17. The PDP of claim 16, wherein the first electrode portion is wider than the second electrode portion.

18. The PDP of claim 17, wherein the second electrode portion is formed off-set from a center of the first electrode portion and in a direction towards a center of the discharge cell.

19. The PDP of claim 17, wherein a cross-sectional shape of the second electrode portion is convex in a direction toward the second substrate and in a direction toward the first substrate.

20. The PDP of claim 16, wherein the display electrode further comprises a transparent electrode;

wherein the bus electrode is arranged along an edge of the transparent electrode; and wherein the second electrode portion is formed off-set from a center of the first electrode portion and toward a center of the discharge cell.

* * * * *